US008386120B2

(12) United States Patent
Johnson

(10) Patent No.: US 8,386,120 B2
(45) Date of Patent: Feb. 26, 2013

(54) METHOD FOR AUTOMATICALLY DETERMINING ENGINE OIL CHANGE FREQUENCY BASED ON FUEL INJECTED

(75) Inventor: Randall L. Johnson, Monee, IL (US)

(73) Assignee: International Engine Intellectual Property Company, LLC., Lisle, IL (US)

( * ) Notice: Subject to any disclaimer, the term of this patent is extended or adjusted under 35 U.S.C. 154(b) by 514 days.

(21) Appl. No.: 12/711,479

(22) Filed: Feb. 24, 2010

(65) Prior Publication Data

US 2011/0208385 A1 Aug. 25, 2011

(51) Int. Cl.
*G07C 5/00* (2006.01)

(52) U.S. Cl. ..... 701/29.5; 340/450.3; 340/457.4; 702/176; 702/184; 73/114.55

(58) Field of Classification Search ..... 701/22, 701/29.4, 29.5, 30, 32.7, 99; 340/438, 450.2, 340/450.3, 457.4; 705/400; 702/50, 130, 702/132, 176, 184; 73/114.55
See application file for complete search history.

(56) References Cited

U.S. PATENT DOCUMENTS

| | | | | |
|---|---|---|---|---|
| 4,054,417 | A | 10/1977 | Rosebrock | |
| 4,525,782 | A * | 6/1985 | Wohlfarth et al. | 701/99 |
| 4,533,900 | A * | 8/1985 | Muhlberger et al. | 340/457.4 |
| 4,630,027 | A * | 12/1986 | Muhlberger et al. | 340/457.4 |
| 4,742,476 | A * | 5/1988 | Schwartz et al. | 701/29.5 |
| 4,847,768 | A * | 7/1989 | Schwartz et al. | 701/29.5 |
| 4,862,393 | A * | 8/1989 | Reid et al. | 701/29.5 |
| 4,923,484 | A | 5/1990 | Saito | |
| 4,970,492 | A * | 11/1990 | King | 340/450.3 |
| 5,332,961 | A * | 7/1994 | Hammerle | 324/700 |
| 5,604,441 | A * | 2/1997 | Freese et al. | 324/663 |
| 6,294,988 | B1 * | 9/2001 | Shomura | 340/438 |
| 6,575,018 | B2 * | 6/2003 | Berndorfer et al. | 73/54.01 |
| 6,580,366 | B1 * | 6/2003 | Engfehr | 340/457.4 |
| 6,776,024 | B2 * | 8/2004 | Jakoby | 73/10 |
| 6,911,830 | B2 * | 6/2005 | Heremans et al. | 324/698 |
| 7,036,464 | B2 * | 5/2006 | Luther et al. | 123/2 |
| 7,259,664 | B1 * | 8/2007 | Cho et al. | 340/450.2 |
| 7,346,448 | B2 * | 3/2008 | Graf et al. | 701/114 |
| 7,706,938 | B2 * | 4/2010 | Palladino | 701/29.4 |
| 2003/0095038 | A1 * | 5/2003 | Dix | 340/425.5 |
| 2004/0236706 | A1 * | 11/2004 | Fitch et al. | 705/400 |
| 2004/0242433 | A1 * | 12/2004 | Roby et al. | 508/185 |
| 2008/0179139 | A1 * | 7/2008 | Montgomery | 184/1.5 |

OTHER PUBLICATIONS

Youngk, R.D. Automobile Engine Reliability, Maintainability and Oil Maintenance, Reliability and Maintainability Symposium, 2000, pp. 94-99.*

* cited by examiner

*Primary Examiner* — Russell Frejd
(74) *Attorney, Agent, or Firm* — Mark C. Bach; Jeffrey P. Calfa

(57) ABSTRACT

A method for automatically determining an engine oil change frequency at an engine control unit includes the steps of determining an amount of fuel used per oil change, and calculating an amount of fuel remaining from the fuel used per oil change. The method also includes the steps of comparing the amount of fuel remaining to a predetermined amount of fuel remaining, and actuating an oil change indicator if the fuel remaining is less than the predetermined amount of fuel.

11 Claims, 2 Drawing Sheets

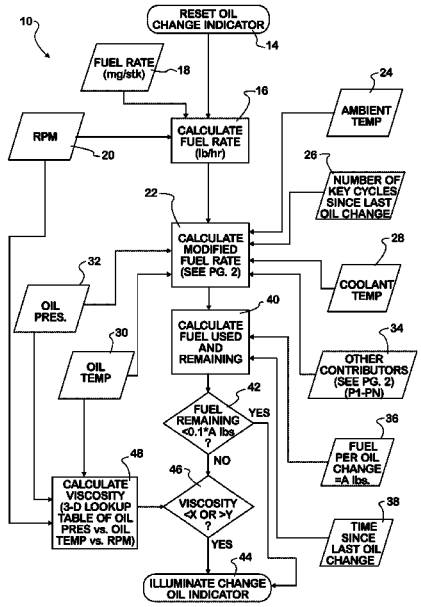

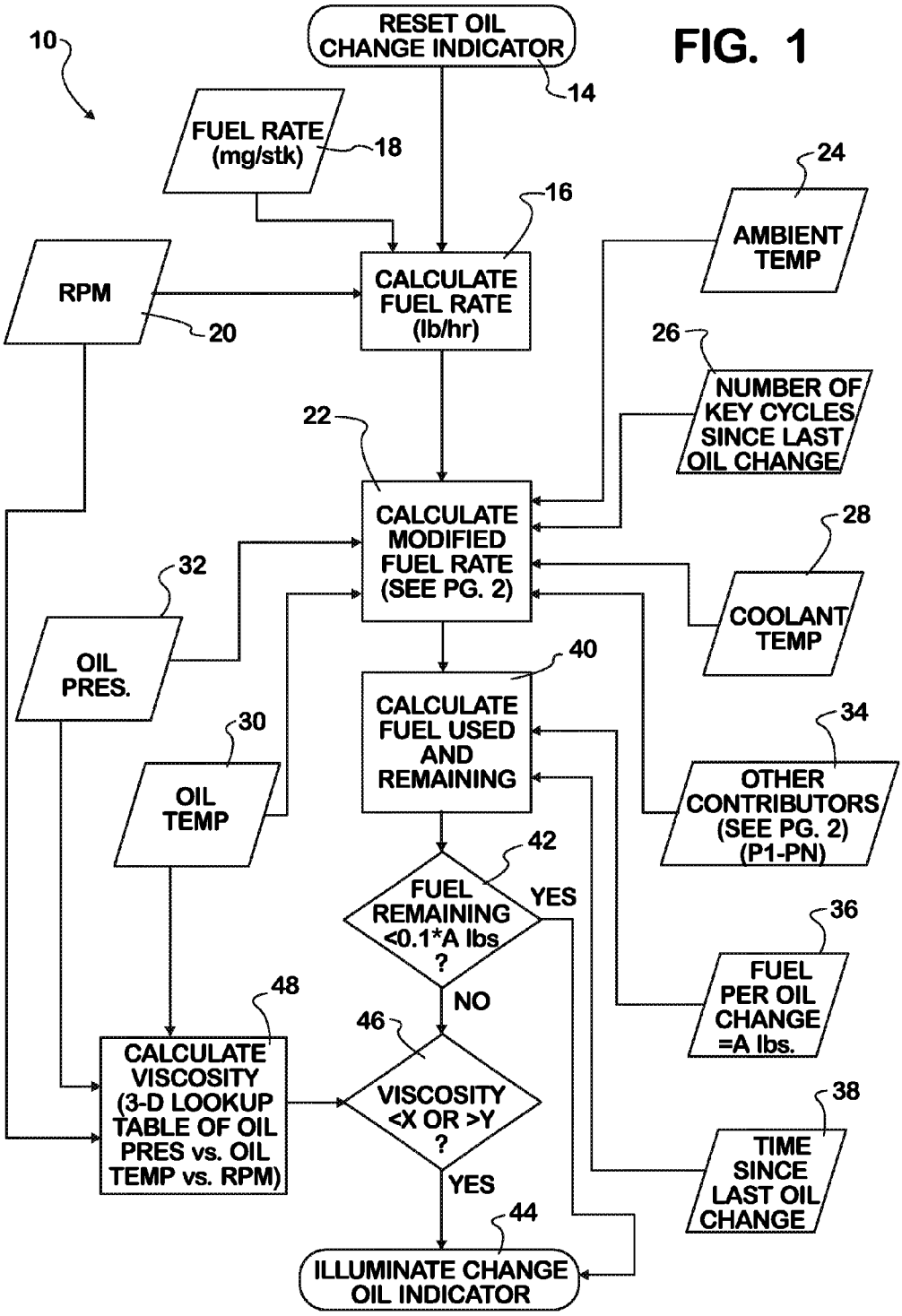
10
RESET OIL CHANGE INDICATOR
14
FIG. 1
FUEL RATE (mg/stk)
18
16
24
AMBIENT TEMP
RPM
20
CALCULATE FUEL RATE (lb/hr)
26
NUMBER OF KEY CYCLES SINCE LAST OIL CHANGE
22
CALCULATE MODIFIED FUEL RATE (SEE PG. 2)
28
32
COOLANT TEMP
OIL PRES.
40
CALCULATE FUEL USED AND REMAINING
30
34
OIL TEMP
OTHER CONTRIBUTORS (SEE PG. 2) (P1-PN)
42
FUEL REMAINING <0.1*A lbs ?
YES
36
FUEL PER OIL CHANGE =A lbs.
NO
48
46
CALCULATE VISCOSITY (3-D LOOKUP TABLE OF OIL PRES vs. OIL TEMP vs. RPM)
VISCOSITY <X OR >Y ?
38
TIME SINCE LAST OIL CHANGE
YES
44
ILLUMINATE CHANGE OIL INDICATOR

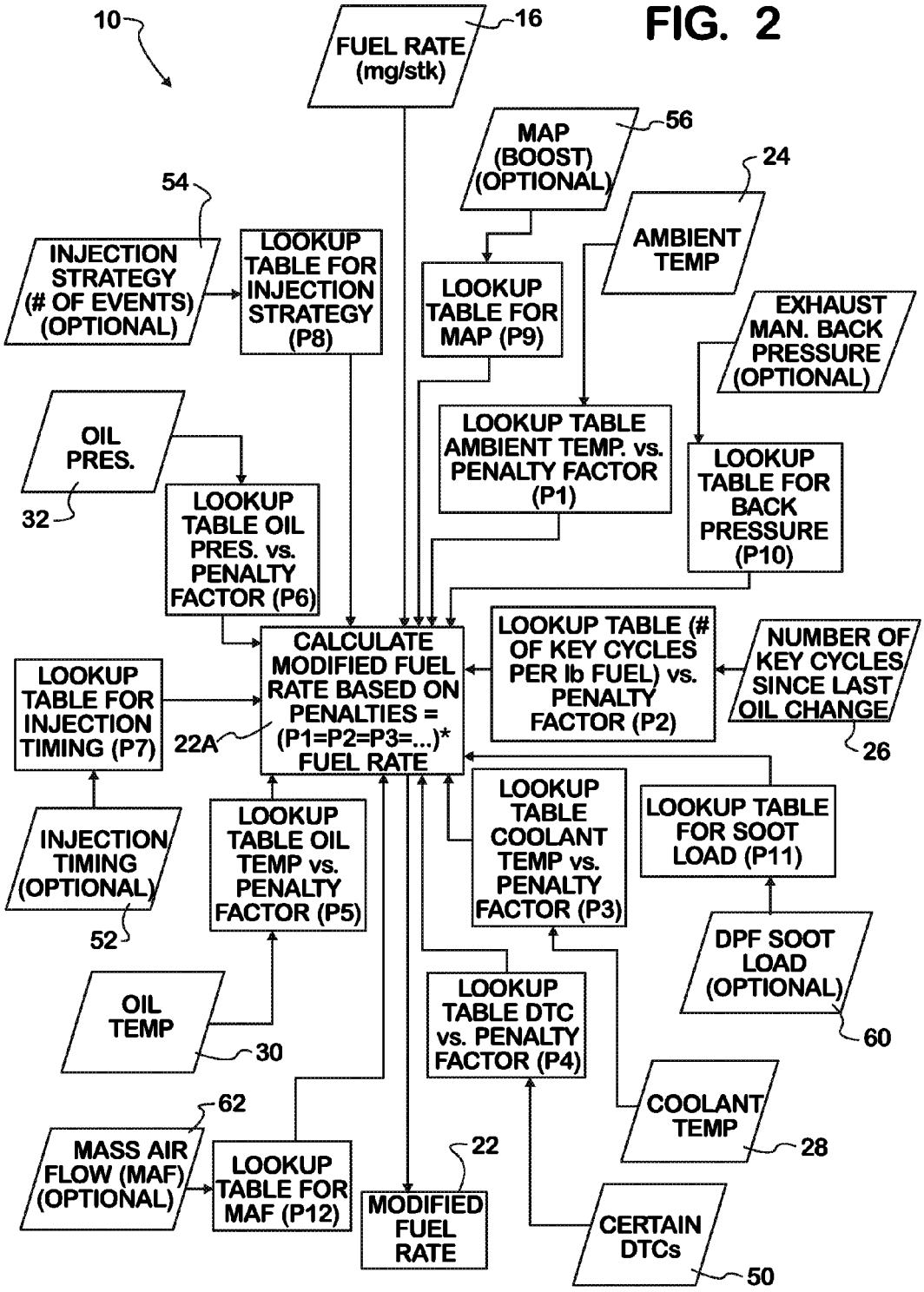
FIG. 2
10
FUEL RATE (mg/stk)
16
MAP (BOOST) (OPTIONAL)
56
24
AMBIENT TEMP
54
INJECTION STRATEGY (# OF EVENTS) (OPTIONAL)
LOOKUP TABLE FOR INJECTION STRATEGY (P8)
LOOKUP TABLE FOR MAP (P9)
EXHAUST MAN. BACK PRESSURE (OPTIONAL)
OIL PRES.
32
LOOKUP TABLE OIL PRES. vs. PENALTY FACTOR (P6)
LOOKUP TABLE AMBIENT TEMP. vs. PENALTY FACTOR (P1)
LOOKUP TABLE FOR BACK PRESSURE (P10)
LOOKUP TABLE FOR INJECTION TIMING (P7)
22A
CALCULATE MODIFIED FUEL RATE BASED ON PENALTIES = (P1=P2=P3=...)* FUEL RATE
LOOKUP TABLE (# OF KEY CYCLES PER lb FUEL) vs. PENALTY FACTOR (P2)
NUMBER OF KEY CYCLES SINCE LAST OIL CHANGE
26
INJECTION TIMING (OPTIONAL)
52
LOOKUP TABLE OIL TEMP vs. PENALTY FACTOR (P5)
LOOKUP TABLE COOLANT TEMP vs. PENALTY FACTOR (P3)
LOOKUP TABLE FOR SOOT LOAD (P11)
DPF SOOT LOAD (OPTIONAL)
60
OIL TEMP
30
LOOKUP TABLE DTC vs. PENALTY FACTOR (P4)
COOLANT TEMP
28
62
MASS AIR FLOW (MAF) (OPTIONAL)
LOOKUP TABLE FOR MAF (P12)
22
MODIFIED FUEL RATE
CERTAIN DTCs
50

METHOD FOR AUTOMATICALLY DETERMINING ENGINE OIL CHANGE FREQUENCY BASED ON FUEL INJECTED

BACKGROUND

Embodiments described herein relate to a method for determining the frequency for changing the engine oil in a vehicle. More specifically, embodiments described herein relate to a method for automatically determining the engine oil change frequency based on fuel consumed by the vehicle.

Engine oil is periodically changed to replace the old oil, which becomes contaminated and depleted of additives through use, with new oil. Typically, the engine oil change interval is based on the distance or time of vehicle usage. However mileage and time may not be accurate indicators of contamination or depletion of additives in the oil. Without accurate indicators, the engine oil may be serviced while it still has useful life, or alternatively, if the useful life of the oil is exceeded, the engine may become damaged.

Engine manufacturers often publish guidelines that detail the oil change service interval. Typically there is a "normal" service interval for engines that undergo typical use, and a "severe" service interval for engines that undergo severe service or operator misuse. Other engine manufacturers have implemented an automatic oil change indicator system, but these systems are typically based on mileage or crankshaft revolutions, which are not necessarily accurate indicators of the condition of the oil. Other automatic oil change indicator systems rely on a sensor to determine the condition of the oil, however these systems are often complex and costly.

SUMMARY

A method for automatically determining an engine oil change frequency at an engine control unit includes the steps of determining an amount of fuel used per oil change, and calculating an amount of fuel remaining from the fuel used per oil change. The method also includes the steps of comparing the amount of fuel remaining to a predetermined amount of fuel remaining, and actuating an oil change indicator if the fuel remaining is less than the predetermined amount of fuel.

Another method for automatically determining an engine oil change frequency includes the steps of modifying the fuel rate based on an oil pressure, an oil temperature, an ambient temperature, a coolant temperature and a number of key cycles since the last oil change. The method includes determining an amount of fuel per oil change, determining a time since the last oil change, and calculating an amount of fuel remaining from the modified fuel rate, the fuel per oil change, and the time since the last oil change. The amount of fuel remaining is compared to a predetermined amount of fuel remaining, where the predetermined amount of fuel remaining is an amount of fuel per oil change times a safety factor. An oil change indicator is actuated if the fuel remaining is less than the predetermined amount of fuel.

In another method for automatically determining an engine oil change frequency, the fuel rate is calculated. The method also includes the steps of calculating a modified fuel rate by multiplying the fuel rate times the sum of a plurality of penalties, where the penalties include at least one of an ambient temperature penalty, a number of key cycles penalty, a coolant temperature penalty, an oil pressure penalty and an oil temperature penalty. The amount of fuel remaining is calculated from the modified fuel rate, and the amount of fuel remaining is compared to a predetermined amount of fuel remaining. The oil change indicator is actuated if the fuel remaining is less than the predetermined amount of fuel.

BRIEF DESCRIPTION OF THE DRAWINGS

FIG. 1 is a flow diagram showing the method for automatically determining engine oil change frequency shown in FIG. 1; and FIG. 2 is a flow diagram showing the method for automatically determining engine oil change frequency continued from FIG. 1.

DETAILED DESCRIPTION

Referring to FIG. 1, a method for automatically determining an engine oil change frequency is indicated generally at 10. Engine oil degradation is primarily due to contaminants from fuel, combustion products, and wear, which are directly proportional to the amount of fuel injected at the engine. The method 10 determines the oil change interval on the amount of fuel injected. Additionally, there are other factors that can influence the build-up, production, and/or reduction of oil contaminants, which are accounted for by the method 10, as discussed below.

The method 10 may be implemented by software on the vehicle, such as at an engine control unit (ECU), however other controllers are possible. The ECU of the vehicle may monitor and/or calculate all of the parameters employed by the method 10. When the ECU determines that the oil should be changed, or should be changed in the near future, the operator is notified by actuation of an indicator on the dashboard of the vehicle, as discussed below.

At reset step 14, the oil change indicator is reset to be "off" or non-actuated indicating that the condition of the oil is satisfactory for vehicle usage. At calculate fuel rate step 16, the fuel rate is calculated from the fuel rate (mg/stk) 18 and the RPM value 20 to get a fuel rate in lb/hr, or any other unit of measurement. Fuel rate 18 is the amount of fuel injected per combustion event per injector. Fuel rate 16 is the fuel rate 18 converted to an aggregate injection rate for the whole engine. For example in a 4-stroke engine, the fuel rate 16 is equal to the fuel rate 18 times the number of cylinders, times rpm/2. The units can be converted from mg to lb and from minutes to hours to get lb/hr. It should be appreciated that, while references to specific units of measurement may be made, that other units of measurements can be used in the method 10.

From the fuel rate 16, a modified fuel rate 22 is calculated using the ambient temperature 24, the number of key cycles since the last oil change 26, and the coolant temperature 28. The modified fuel rate 22 is also calculated using the oil temperature 30 and the oil pressure 32. As will be discussed below with respect to FIG. 2, other parameters, referred to as "penalties" may be used to calculate the modified fuel rate 22 at step 34.

Using the previously calculated modified fuel rate 22, and also using a fuel used per oil change (A lbs) 36, and a time duration since the last oil change 38, the amount of fuel remaining 40 is calculated. The fuel per oil change A may be determined by measurement, input into the ECU, or may be a parameter that is predetermined by the manufacturer through testing.

When the amount of fuel remaining 40 is known, the amount of fuel injected is also known. At step 42, if the value of the fuel remaining is less than (0.1×A lbs), or less than about 10% of the total fuel used per oil change, then the change oil indicator 44 on the dashboard is illuminated or otherwise actuated to notify the operator of the vehicle that it is time for an oil change to occur. The number 0.1 is a safety factor, however other values can be used, for example a value of 0.05 or 0.15. In this way, there is a direct relationship between the amount of fuel injected/remaining 40 and actuation of the oil change indicator 44.

The method 10 employs an optional oil viscosity check. If at step 42, the value of the fuel injected/remaining 40 is greater than or equal to a predetermined fuel amount of fuel remaining (0.1*A lbs), then the viscosity of the oil is checked at step 46. At check step 46, if the viscosity of the oil is determined to be outside of a predetermined range, <X or >Y, then the change oil indicator on the dashboard is illuminated or otherwise actuated to notify the operator of the vehicle at step 44. If the viscosity of the oil is determined to be within the range, then the oil indicator is not actuated. In this way, check step 46 verifies that the viscosity of the oil is within predetermined limits. The viscosity of the oil is determined at step 48 using the oil temperature 30, the oil pressure 32 and the RPM 20. A lookup table may be used to calculate the viscosity at step 48.

Referring now to FIG. 1 and FIG. 2, the modified fuel rate 22 may be calculated based on other parameters, referred to as "penalties" 34. At calculation step 22A, the equation ((P1+P2+P3+ . . . +Pn)×Fuel Rate), where P1 to Pn are the penalties applied, and Fuel Rate is the fuel rate 16. The equation is used to calculate the modified fuel rate 22. It should be understood that, aside from the ambient temperature 24, the number of key cycles 26, the coolant temperature 28, the oil temperature 30 and the oil pressure 32, the other penalties Pn applied to the modified fuel rate 22 calculation are optional and are not limited to the penalties discussed below.

A first penalty (P1) is an ambient temperature penalty obtained using the ambient temperature 24. The first penalty P1 may be determined from a lookup table, which is populated by the manufacturer. Testing would be conducted to determine the effects of ambient temperature on the condition of the oil for the specific engine and application. Typically, lower ambient temperatures result in higher concentrations of water and acids in the oil. Higher ambient temperatures can result in higher oil temperatures.

A second penalty (P2) is a cycles-per-pound-of-fuel penalty that may be determined by a lookup table. The number of key cycles since the previous oil change 26 is used in the lookup table. Similarly, this lookup table may be populated by the manufacturer through testing. Frequent restarts may result in increased shearing of the oil or increased contaminants from poor initial combustion.

A third penalty (P3) to be calibrated by the manufacturer is a coolant temperature penalty. The penalty P3 may be determined from a lookup table using the coolant temperature 28. Lower coolant temperatures result in poor combustion chamber sealing, leading to additional contaminants in the engine oil.

A fourth penalty (P4) is a Diagnostic Trouble Code (DTC) penalty that may be determined by certain DTCs. 50. If the ECU determines that there is a component failure on the engine, the oil change algorithm can introduce a penalty so that the oil is changed sooner. For example, if an EGR valve is stuck open, contaminants from combustion will increase.

A fifth penalty (P5) is an oil temperature penalty that may be determined by a lookup table that is calibrated by the manufacturer via testing. The oil temperature 30 is used to determine the oil temperature penalty P5. Similar to ambient temperature, low oil temperatures can result in increased condensation and acid formation. Conversely, high oil temperatures will result in increased oil oxidation.

A sixth penalty (P6) is an oil pressure penalty that may be determined by a lookup table calibrated by the manufacturer. The oil pressure 32 is used to determine the oil pressure penalty P6. Lower oil pressure may be indicative of dilution with fuel. Higher oil pressure indicates oxidized oil or soot build up.

An optional seventh penalty (P7) is an injection timing penalty that may be determined by a lookup table. The injection timing value 52 is used to determine the injection timing penalty P7. The ECU adjusts injection timing based on various operating parameters. The injection timing changes the combustion characteristics that can lead to additional oil contamination.

An optional eighth penalty (P8) is an injection strategy penalty that may be determined by a lookup table. An injection strategy value 54 of number of injection events is used to determine the injection strategy penalty P8. The number of injection events changes the combustion characteristics and changes the amount of contamination from combustion. Additionally, late fuel injection may be used to heat up exhaust catalysts under certain conditions. This late fuel injection may lead to increased fuel contamination in the oil.

An optional ninth penalty (P9) is a Manifold Air Pressure (MAP) or boost penalty that may be determined by a lookup table. The MAP boost value 56 is used to determine the MAP penalty P9. Boost levels can change the combustion characteristics leading to more or less oil contamination.

An optional tenth penalty (P10) is an exhaust back pressure penalty that may be determined by a lookup table. The exhaust back pressure value 58 is used to determine the back pressure penalty P10. Changes in exhaust backpressure can lead to variations in combustion byproducts. This can lead to increased oil degradation.

An optional eleventh penalty (P11) is a diesel oxidation catalyst soot load penalty that may be determined by a lookup table. A diesel oxidation catalyst soot load value 60 is calculated by the ECU from exhaust pressure sensors. It can then be used to determine the soot load penalty P11. Increased soot load can lead to decreased engine air flow. This can result in additional oil contamination due to changes in combustion.

An optional twelfth penalty (P12) is a mass air flow penalty that may be determined by a lookup table. The mass air flow value 62 is used to determine the mass air flow penalty P12. Changes in air flow for a given operating condition can lead to changes in oil contamination and degradation.

It is possible that the penalty values can be obtained in other ways than a look-up table. Further, it is possible that other penalty values can be used in combination with or separate from the penalties P1-P12, where the penalties are used to calculate a modified fuel rate and a quantify of fuel injected and/or remaining.

By determining the amount of fuel injected, the oil change interval is based on the direct contributor to oil degradation. The method 10 may provide increased accuracy in determining the useful life of the oil, may reduce the frequency of service, may lower maintenance costs, may reduce environmental waste, and may reduce or prevent engine damage attributed to improper service intervals.

What is claimed is:

1. A method for automatically determining an engine oil change frequency at an engine control unit, the method comprising the steps of:

calculating a fuel rate;

modifying the fuel rate based on an oil pressure, an oil temperature, an ambient temperature, a coolant temperature and a number of key cycles since the last oil change to obtain a modified fuel rate;

determining an amount of fuel used per oil change;

determining a time since the last oil change;

calculating an amount of fuel remaining from the modified fuel rate, the fuel per oil change, and the time since the last oil change;

comparing the amount of fuel remaining to a predetermined amount of fuel remaining, where the predetermined amount of fuel remaining is an amount of fuel per oil change times a safety factor; and actuating an oil change indicator if the fuel remaining is less than the predetermined amount of fuel.

2. The method of claim 1 wherein the safety factor is about 0.1.

3. The method of claim 1 further comprising the step of calculating the modified fuel rate on the basis of at least one of DTC, injection timing, injection strategy, MAP, exhaust back pressure, soot load and mass air flow.

4. The method of claim 1 further comprising the step of not actuating an oil change indicator if the fuel remaining is greater than the predetermined amount of fuel.

5. The method of claim 4 further comprising the step of comparing a viscosity of the oil with a predetermined range of viscosities, wherein if the viscosity is outside of the predetermined range of viscosity, the oil change indicator is actuated.

6. The method of claim 5 further comprising the step of determining the viscosity of the oil from a lookup table using RPM, an oil pressure and an oil temperature.

7. The method of claim 4 further comprising the step of comparing a viscosity of the oil with a predetermined range of viscosity, wherein if the viscosity is within the predetermined range of viscosity, the oil change indicator is not actuated.

8. The method of claim 1 wherein the step of actuating the oil change indicator further comprises illuminating the oil change indicator.

9. A method for automatically determining an engine oil change frequency at an engine control unit, the method comprising the steps of:

calculating a fuel rate;

calculating a modified fuel rate by multiplying the fuel rate times the sum of a plurality of penalties, wherein the penalties comprise at least one of an ambient temperature penalty, a number of key cycles penalty, a coolant temperature penalty, an oil pressure penalty and an oil temperature penalty;

calculating an amount of fuel remaining from the modified fuel rate;

comparing the amount of fuel remaining to a predetermined amount of fuel remaining; and actuating an oil change indicator if the fuel remaining is less than the predetermined amount of fuel.

10. The method of claim 9 wherein the predetermined amount of fuel remaining is an amount of fuel per oil change times a safety factor, wherein the safety factor is between 0.05 and 0.15.

11. The method of claim 9 further comprising the step of comparing a viscosity of the oil with a predetermined range of viscosities, wherein if the viscosity is outside of the predetermined range of viscosity, the oil change indicator is actuated.

* * * * *